US006953161B2

(12) United States Patent
Laursen et al.

(10) Patent No.: US 6,953,161 B2
(45) Date of Patent: Oct. 11, 2005

(54) NOZZLE, ESPECIALLY AN ATOMIZING NOZZLE FOR AN OIL BURNER

(75) Inventors: Birthe Noergaard Laursen, Soenderborg (DK); Chinh Minh Trinh, Soenderborg (DK)

(73) Assignee: Danfoss A/S, Nordborg (DK)

( * ) Notice: Subject to any disclaimer, the term of this patent is extended or adjusted under 35 U.S.C. 154(b) by 1 day.

(21) Appl. No.: 10/721,109

(22) Filed: Nov. 25, 2003

(65) Prior Publication Data

US 2004/0112990 A1 Jun. 17, 2004

(30) Foreign Application Priority Data

Dec. 4, 2002 (DE) ..... 102 56 533

(51) Int. Cl.[7] ..... B05B 1/26; B05B 1/34
(52) U.S. Cl. ..... 239/461; 239/381; 239/481
(58) Field of Search ..... 239/461, 481, 239/381

(56) References Cited

U.S. PATENT DOCUMENTS 2,055,864 A * 9/1936 Harsch ..... 239/462
2,126,440 A 8/1938 Apthorp
3,672,578 A * 6/1972 Wayne ..... 239/590
3,711,242 A 1/1973 Bowman
4,611,758 A 9/1986 Geberth, Jr.
4,613,079 A * 9/1986 Mains ..... 239/462
4,624,413 A 11/1986 Corsette
4,736,893 A * 4/1988 Norskov ..... 239/590.3
4,989,790 A * 2/1991 Martin et al. ..... 239/483
5,002,230 A 3/1991 Norskov et al.
5,499,766 A * 3/1996 Foster et al. ..... 239/333

FOREIGN PATENT DOCUMENTS

DE 2708138 A 8/1978
JP 55134751 A2 10/1980

* cited by examiner

*Primary Examiner*—David A. Scherbel
*Assistant Examiner*—James S. Hogan
(74) *Attorney, Agent, or Firm*—McCormick, Paulding & Huber LLP

(57) ABSTRACT

A nozzle, especially an atomizing nozzle for an oil burner, has a housing with a nozzle opening, and a distributing insert which from the interior of the housing lies on the housing in the area of the nozzle opening and is held in the housing with the help of a deformed housing section. To better assure the functioning of the nozzle an elastically deformable element is arranged between the housing section and the distributing insert.

15 Claims, 2 Drawing Sheets

NOZZLE, ESPECIALLY AN ATOMIZING NOZZLE FOR AN OIL BURNER

CROSS-REFERENCE TO RELATED APPLICATIONS

This application is entitled to the benefit of and incorporates by reference essential subject matter disclosed in German Patent Application No. 102 56 533.3 filed on Dec. 4, 2002.

FIELD OF THE INVENTION

The invention concerns a nozzle, especially an atomizing nozzle for an oil burner, with a housing having a nozzle opening, and a distributing insert which in the area of the nozzle opening is held inside of the housing so as to engage the housing in the area of the nozzle opening and which with the help of a deformed housing section is held in the housing.

BACKGROUND OF THE INVENTION

One such nozzle is known from DE 36 02 941 C1. The distributing insert together with the housing forms channels which run to the nozzle opening and produce a spin in the fluid which is to be ejected from the nozzle. The distributing insert is secured through a holding element solely with the help of a radial deformation of the housing section. Thereby, one avoids that in the assembly of the nozzle or in a later processing chips can exist which can plug the channels between the distributing insert and the housing or which can plug the jet opening itself.

Above all, it has been found that in the radial flanging process, that is the radial bending of the housing section, the conically shaped end of the distributing insert does not always remain pressed with the required reliability against the corresponding conically shaped inner side of the housing. As a result of this, the heating oil which is to be atomized by the nozzle not only flows in the grooves of the distributing insert, but also can be forced to flow through other paths between the housing and the distributing insert to the nozzle opening. This diminishes the spinning motion applied to the fluid so that the functioning of the nozzle is diminished.

The invention has as its object the ability to better guarantee the functioning of the nozzle.

SUMMARY OF THE INVENTION

This object is solved by a nozzle of the previously mentioned kind and which has an elastically deformable element arranged between the housing section and the distributing insert.

In this way it is possible to in the deforming of the housing section to create a considerable constant tension in the axial direction and indeed in the elastic element. The elastic element constantly holds the tension by means of which the distributing insert is pressed against the housing. Therefore, a reliable positioning of the distributing insert onto the housing is assured.

Preferably, the housing section in its deformed condition tensions the distributing insert axially against the housing. One therefore no longer fastens the distributing insert only with a radial deformation, that is a radial flange, but one uses, with reference to an axis through the nozzle opening, a bending of the housing in the axial direction. Thereby, the distributing insert is held fast between the housing and the deformed housing section in the axial direction by a constant tensioning. By the deformation of the housing section considerably larger forces can also be transferred to the distributing insert, then is possible with only a radial flange. Thereby, it is assured that oil can penetrate only through the grooves between the housing and the distributing insert to the nozzle opening, and not somehow through a parasitic path which can come about by a small lifting of the distributing nozzle from the housing. Thus, it is assured that the fluid is given the desired spinning motion so that the atomization takes place to the desired degree.

Preferably, the housing section works with a force of at least 100 N onto the distributing insert. Thereby it is assured that the distributing insert is pressed with the necessary reliability against the inner forward end of the housing. Since this forward end is conically shaped and has a contour suiting that of the shape of the distributing insert, it is assured that the distributing insert remains in the desired position.

Preferably, the elastically deformable element defines a flow path. The fluid, which is to be atomized by the nozzle, therefore passes through the elastically deformable element. The elastically deformable element therefore forms no hindrance to the fluid.

Preferably, the elastically deformable element leaves at its end which neighbors the distributing insert a space free from the radially inner wall of the housing. Thereby one achieves that the flow path for the fluid to be atomized, that is the oil to be atomized or a gas delivered to it, must enter a gap or groove between the housing and the distributing insert in order to finally get to the nozzle opening. The elastically deformable element allows this space to be free.

Preferably, the flow path passes outwardly through at least one opening in the elastically deformable element. For this the elastically deformable element preferably has one opening. It is also possible that the elastically deformable element is entirely pervious.

Preferably, the elastically deformable element is formed as a tube. A tube shaped element can easily be elastically deformed because it in comparison to a massive body has a relatively small wall thickness. The elastic deformation, that is the springy restorability of the element, permits the axial forces from the deformation of the housing section to be directly transmitted to the distributing insert.

Preferably, the elastically deformable element has a first section with a larger diameter and a second section with a smaller diameter, between which sections is arranged a transitional section with an inclined wall. This allows in a simple way to achieve a matching to a housing geometry. In areas with thick diameters the element can lie from inwardly onto the housing. In areas with thin diameters it can then formed an annular channel between the housing wall and the element. With certain materials, for example hardened spring steel, the transitional section can also form a deformation region. This among other things is also dependent on the wall thickness of the element.

In this case it is preferred that the outer diameter of the second section is smaller than the inner diameter of the first section. This provides especially favorable spring characteristics for the transitional section.

In an alternative embodiment it can be provided that the elastically deformable element is formed by a cylindrical body with an axially running surface groove and a circumferential groove. The circumferential groove can thereby cut deeper into the "flesh" of the cylindrical body than the axial groove. Thereby the possibility is available that the deformed housing section somewhat springingly deforms the area of the cylindrical body when the deformation in the axial direction takes place with the necessary force. In this case, it can be provided that the circumferential groove widens in going toward the deformed housing section. The cylindrical body therefore is made thinner in this section in an axial direction so that it can be more easily elastically deformed.

Preferably, the elastically deformable element and the distributing insert are formed as one piece. This simplifies the assembly of the nozzle. One need therefore handle only a single part which becomes inserted into the housing. In a further alternative, it can be provided that the elastically deformable element is formed by a spring. The spring can for example be formed as a helical compression spring. It is also possible that the spring can be formed as a plate spring.

It is of advantage that the spring works through a tubular support element onto the distributing insert. In this case, the entire inner space of the housing between the distributing insert and the deformed housing section need not be formed by the spring element. The spring supports itself then much more on a circumferential flange of the supporting element. The tubular shaped supporting element can then pass telescopically through the spring. The deformed housing section can extend in the radial direction by only a limited amount so that it works only on a spring and not on the tubular support element.

BRIEF DESCRIPTION OF THE DRAWINGS

The invention is described in more detail in the following by way of preferred embodiments in combination with the drawings. The drawings are.

DETAILED DESCRIPTION OF THE PREFERRED EMBODIMENTS

Figure 1:
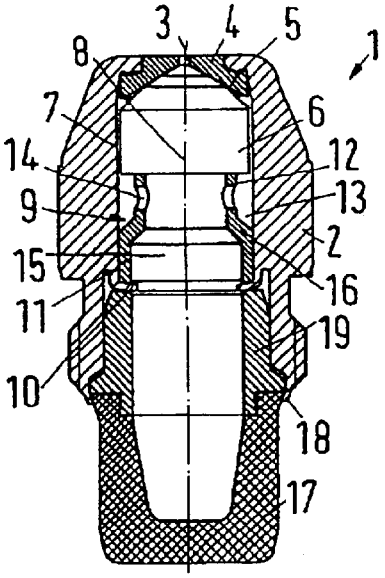
FIG. 1 shows a first embodiment a nozzle.

A nozzle 1 according to FIG. 1 has a housing 2 which in the area of its forward end has a nozzle opening 3. The nozzle opening 3 is provided in a housing part 4. The housing part 4 has on its inner side a conically shaped taper 5.

From inwardly of the nozzle a distributing insert 6 lies on the taper 5, which insert is arranged in the housing 2 with a surrounding gap 7. An axis 8 of the distributing insert 6 coincides with the axis through the nozzle opening 3.

In a way known in itself and not illustrated in more detail, between the housing part 4 and the distributing insert 6 channels are provided through which a fluid, for example heating oil, to be atomized by the nozzle 1 is given a spinning motion before it is expelled through the nozzle opening 3.

The distributing insert 6 is held, by an elastically deformable element 9, in engagement with the taper 5, which is also known as the "end plate" of the housing part 4. The elastically deformable element 9 in turn is pressed by a certain force against the distributing insert 6 by a bending of a housing section 10. The housing section 10 is so bent or flanged that it not only works in the radial direction, but also on the elastically deformable element 9 in the axial direction (with reference to the axis 8), and indeed with a relatively large force, which amounts to at least 500 N.

In regard to the bending of the housing section 10, one need not work with too great precision and one can also create greater forces. A damaging of the distributing insert 6 or of the housing 2 with its housing part 4 is inhibited by the elastically deformable element 9 which takes up excessive forces.

The element 9 is formed as tube. It has a first section 11 with a larger diameter and a second section 12 with a smaller diameter. Between the second section 12 and the housing 2 a free annular space 13 is given which stands in connection with the interior 15 of the element 9 by way of openings 14. Between the first section 11 and the second section 12 is a transitional section 16 which is inclined to the axis 8 and is therefore shaped somewhat as a truncated cone. With this transitional section one achieves a diameter reduction.

The outer diameter of the second section 12 is smaller or at most exactly as large as the inner diameter of the first section 11. In this way it is achieved that between the housing 2 and the element 9 the annular space 13 can be formed with a thickness which corresponds at least to the wall thickness of the element 9 in the section 11. The deformation occurs by the compression of the entire element.

At the end of the housing 2, which lies oppositely to the nozzle opening 3, is arranged an oil filter 17 which is held fixed to the housing 2 by a radially deformed housing section 18. The fixing can be assisted by a spacer 19 which on its side facing the nozzle opening 3 lies on the axially deformed housing section 10.

Liquid which enters the interior 15 of the elastically deformable element 9 through the oil filter 17 passes through the openings 14 into the annular space 13 and from there enters the gap 7 between the distributing insert 6 and the housing 2. From this gap the fluid moves into the non-illustrated channels between the housing part 4 and the distributing insert 6 and thereby lastly reaches the nozzle opening 3 where the fluid is ejected with a spin and is atomized.

Figure 2:
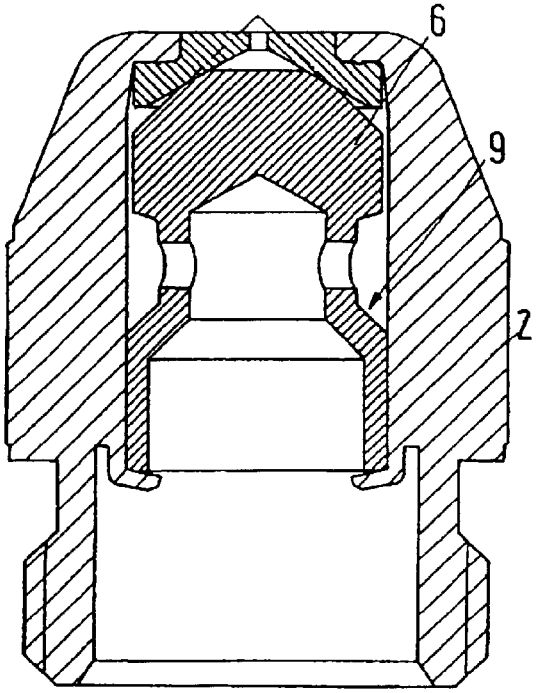
FIG. 2 shows a second embodiment of a nozzle.

FIG. 2 shows a modified embodiment, which differs from the embodiment of FIG. 1 in that the distributing insert 6 and the element 9 are made as one piece. The remaining parts correspond with those of FIG. 1 and are accordingly provided with the same reference number.

Figure 3:
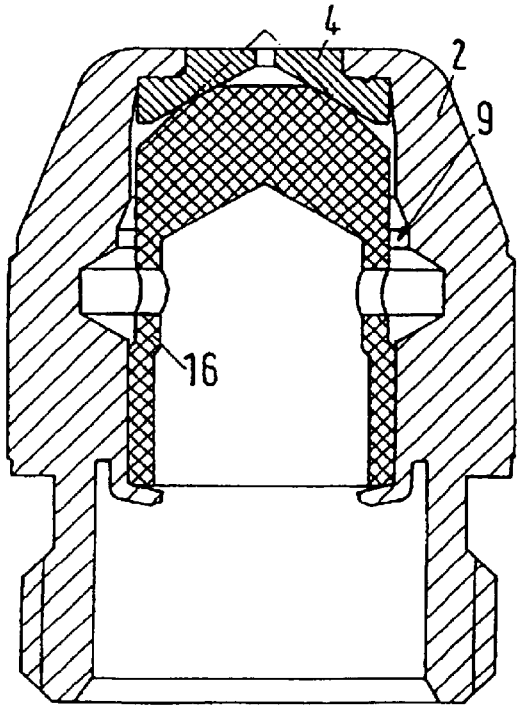
FIG. 3 shows a third embodiment of a nozzle.

In the embodiments according to FIGS. 1 and 2, the elastically deformable element 9 is formed from a metal, for example brass and/or hardened steel, and in the embodiment according to FIG. 3, in which the same parts as in FIGS. 1 and 2 have been provided with the same reference numerals, the elastically deformable element 9 is made of a plastic material. Here also a transitional section 16 is provided even if it is not so pronounced.

Figure 5:
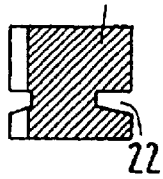
FIG. 5 shows a sectional view through an elastically deformable element.
Figure 6:
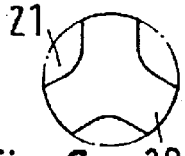
FIG. 6 shows a plan view of the element of FIG. 5.
Figure 4:
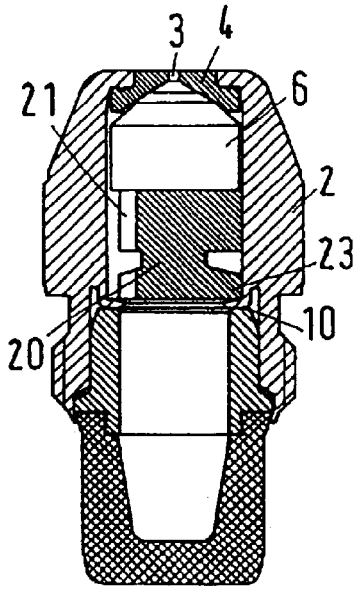
FIG. 4 shows a fourth embodiment of a nozzle.

FIG. 4 shows a fourth embodiment of a nozzle 1 in which an elastically deformable element 20 is provided, which is illustrated in more detail in FIGS. 5 and 6. The element 20 first of all has three axial grooves 21 uniformly distributed in the circumferential direction. The flow path of the fluid passes through these axial grooves 21 to the nozzle opening 3. Moreover, the element 20 has further a circumferential groove 22 which radially outwardly widens toward the deformed housing section 10 so that the deformed housing section 10 engages a relatively small area 23 of the element

20. The area 23 therefore forms the real "spring", that is the area of the element 20 which is elastically deformable.

By the choice of the position of the circumferential groove 22 the spring characteristic of the element 20 can be determined within certain limits. Naturally, a further limiting quantity is the material of the element 20. Also here one can, for example use brass, with the elastically deformable element 20 being formed from rod material cut into predetermined lengths. The introduction of the axial grooves 21 and of the circumferential grooves 22 is possible by means of milling or turning.

Figure 7:
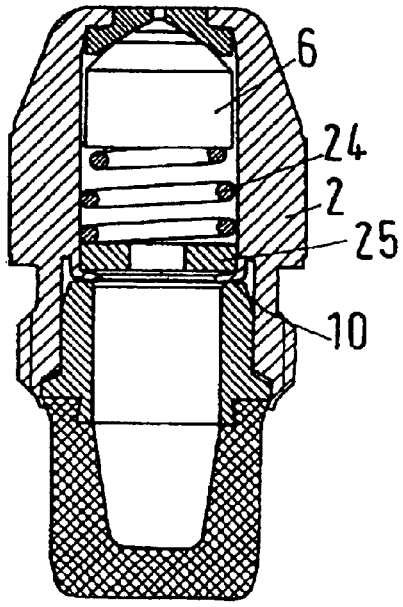
FIG. 7 shows a fifth embodiment of a nozzle.

FIG. 7 shows a fifth embodiment in which the same parts have been provided with the same reference numbers. Here, as the elastically deformable element a helical compression spring 24 is provided which lies on the distributing insert 6. On its opposite side the helical compression spring 24 lies on an intermediate support disk 25 which in turn is held in place by the axially deformed housing section 10 and is acted upon by the pressure.

Figure 8:
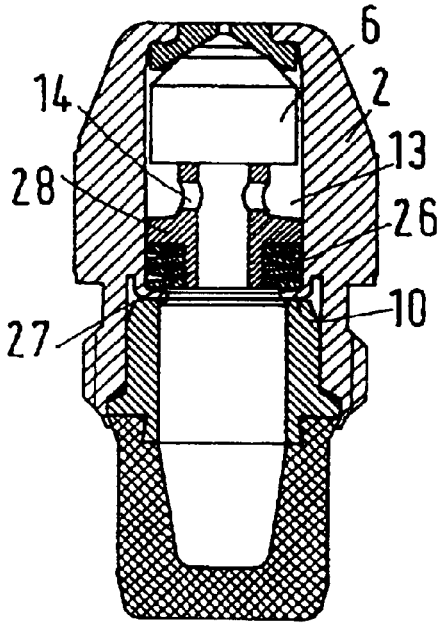
FIG. 8 shows a sixth embodiment of a nozzle.

FIG. 8 shows a further alternative in which plate springs 26 are provided to hold the distributing insert 6 in the housing 2. The plate springs 26 surround a tubular support element 27 which can telescope inside of the plate springs 26. The support element 27 has a surrounding flange 28 against which the plate springs 28 abut. In the support element 26 openings 14 are provided through which the fluid can pass into the annular space 13.

The axially deformed housing section 10 here works directly onto the plate springs 26. It is, however, short enough in the radial direction in order not to come into conflict with the supporting element 27.

What is claimed is:

1. A nozzle, especially an atomizing nozzle for an oil burner, comprising a housing, which housing has a nozzle opening, and a distributing insert, which insert from the interior of the housing lies on the housing in the area of the nozzle opening and which insert is held in the housing with the help of a deformed housing section, and wherein between the housing section and the distributing insert is arranged an elastically deformable element.

2. A nozzle according to claim 1, wherein the housing section in the deformed condition tensions the distributing insert axially toward the housing.

3. A nozzle according to claim 1, wherein the housing section works with a forced of at least 100 N on the distributing insert.

4. A nozzle according to claim 2, wherein the elastically deformable element defines a flow path.

5. A nozzle according to claim 4, wherein the elastically deformable element on its end which neighbors the distributing insert defines a free space with the radially inner wall of the housing.

6. A nozzle according to claim 4, wherein the flow path passes outwardly through at least one opening in the elastically deformable element.

7. A nozzle according to claim 2, wherein the elastically deformable element is formed as a tube.

8. A nozzle according to claim 7, wherein the elastically deformable element has a first section with a larger diameter and a second section with a smaller diameter, between which first and second sections is arranged a transitional section with an inclined wall.

9. A nozzle according to claim 8, wherein the outer diameter of the second section is smaller than the inner diameter of the first section.

10. A nozzle according to claim 2, wherein the elastically deformable element is formed by a cylindrical body with an axially running surface groove and a circumferential groove.

11. A nozzle according to claim 2, wherein the elastically deformable element and the distributing insert are formed as one piece.

12. A nozzle according to claim 2, wherein the elastically deformable element is formed by a spring.

13. A nozzle according to claim 12, wherein the spring is formed as a helical compression spring.

14. A nozzle according to claim 12, wherein the spring is formed as a plate spring.

15. A nozzle according to claim 12, wherein the spring works on the distributing insert through a tubular supporting element.

* * * * *